US009278369B2

(12) United States Patent
Lee et al.

(10) Patent No.: US 9,278,369 B2
(45) Date of Patent: Mar. 8, 2016

(54) WATER DANCING SPEAKER

(71) Applicant: ATAKE DIGITAL TECHNOLOGY (SHENZHEN) CO., LTD., Shenzhen, Guangdong Province (CN)

(72) Inventors: Kuo Tsai Lee, Shenzhen (CN); Weiwen Tan, Shenzhen (CN)

(73) Assignee: ATAKE DIGITAL TECHNOLOGY (SHENZHEN) CO., LTD., Shenzhen, Guangdong Province (CN)

( * ) Notice: Subject to any disclaimer, the term of this patent is extended or adjusted under 35 U.S.C. 154(b) by 0 days.

(21) Appl. No.: 14/614,384

(22) Filed: Feb. 4, 2015

(65) Prior Publication Data

US 2015/0231661 A1 Aug. 20, 2015

(30) Foreign Application Priority Data

Feb. 19, 2014 (CN) ..... 2014 2 0072261 U

(51) Int. Cl.

| | |
|---|---|
| ***B05B 17/08*** | (2006.01) |
| ***B05B 15/00*** | (2006.01) |
| ***F04D 13/06*** | (2006.01) |
| ***F21V 33/00*** | (2006.01) |
| ***H04R 1/44*** | (2006.01) |
| *F21W 121/02* | (2006.01) |
| *F21Y 101/02* | (2006.01) |
| *F21Y 113/00* | (2006.01) |

(52) U.S. Cl.

CPC ..... *B05B 17/08* (2013.01); *B05B 15/00* (2013.01); *F04D 13/06* (2013.01); *F21V 33/006* (2013.01); *F21V 33/0052* (2013.01); *H04R 1/44* (2013.01); *F21W 2121/02* (2013.01); *F21Y 2101/02* (2013.01); *F21Y 2113/005* (2013.01)

(58) Field of Classification Search

CPC ..... B05B 15/00; B05B 17/08; F04D 13/02; F04D 13/06; F21V 33/0004; F21V 33/0052; F21V 33/0056; F21V 33/006; F21W 2121/02; F21Y 2101/02; F21Y 2113/002; F21Y 2113/005; H04R 1/44

USPC ..... 239/17–23, 289

See application file for complete search history.

(56) References Cited

U.S. PATENT DOCUMENTS

| | | | | | |
|---|---|---|---|---|---|
| 1,888,784 | A * | 11/1932 | Bauer | B05B 17/08 | 239/23 |
| 1,954,704 | A * | 4/1934 | Kraus | B05B 17/08 | 222/384 |
| 3,337,133 | A * | 8/1967 | Duerkob | B05B 17/08 | 137/624.13 |
| 3,619,084 | A * | 11/1971 | Gordon | B05B 17/08 | 137/412 |
| 4,705,216 | A * | 11/1987 | Kaffka | F21S 8/00 | 239/18 |
| 5,069,387 | A * | 12/1991 | Alba | B05B 17/08 | 239/18 |
| 5,234,728 | A * | 8/1993 | Chiang | B44F 1/00 | 239/18 |
| 6,053,423 | A * | 4/2000 | Jacobsen | B05B 17/08 | 239/17 |
| 6,206,298 | B1 * | 3/2001 | Ting | B05B 17/085 | 239/20 |
| 6,416,197 | B1 * | 7/2002 | Chang | F21S 6/002 | 239/20 |
| 6,505,782 | B1 * | 1/2003 | Yen | B05B 17/08 | 239/17 |

(Continued)

*Primary Examiner* — Christopher Kim

(74) *Attorney, Agent, or Firm* — Cheng-Ju Chiang

(57) ABSTRACT

A water dancing speaker is disclosed. The water dancing speaker comprises a housing assembly, a liquid spraying device, a liquid spraying power supplying device, a liquid column steering device, a driving device and an audio device. The housing assembly is formed with an exhibiting cavity, a partition cavity and an audio cavity, and the liquid spraying device can produce a liquid column. The water dancing speaker of the present disclosure can produce liquid columns that vary rhythmically with the audio characteristics of the played tracks, which improves the ornamental effect of the speaker.

18 Claims, 2 Drawing Sheets

(56) References Cited

U.S. PATENT DOCUMENTS 6,611,114 B1 * 8/2003 Yen ..... A63J 17/00 239/16

6,695,222 B1 * 2/2004 Lin ..... B05B 17/08 239/17

6,717,383 B1 * 4/2004 Brunt ..... A01K 63/047 239/18

* cited by examiner

WATER DANCING SPEAKER

FIELD OF THE INVENTION

The present disclosure generally relates to the technical field of speaker, and more particularly, to a water dancing speaker.

BACKGROUND OF THE INVENTION

Water dancing speakers of the prior art have relatively simple shapes and functions, and the fountain spraying device thereof can only spray liquid columns of a single style upwardly in response to the change of music rhythms, so the fountain spraying effect is unsatisfactory and the ornamental value is insufficient. Meanwhile, users cannot set the fountain spraying effect exhibited by the water dancing speakers according to their own preferences, so the water dancing speakers have poor extensibility and cannot satisfy various requirements of the users.

SUMMARY OF THE INVENTION

Accordingly, the present disclosure provides a water dancing speaker which intends to achieve various fountain spraying effects to improve the ornamental value and meanwhile allows users to set the presented fountain spraying effect depending on practical needs.

To solve the aforesaid technical problems, the present disclosure provides a water dancing speaker which comprises a housing assembly, a liquid spraying device, a liquid spraying power supplying device, a liquid column steering device, a driving device and an audio device. The housing assembly is formed with an exhibiting cavity, a partition cavity and an audio cavity, the exhibiting cavity and the partition cavity are disposed separately from each other, the liquid spraying device, the liquid spraying power supplying device and the liquid column steering device are accommodated within the exhibiting cavity, the driving device is accommodated within the partition cavity, the audio device is accommodated within the audio cavity, the liquid spraying power supplying device is connected to and drives the liquid spraying device and the liquid column steering device respectively, and the driving device drives, via a magnetic force, the liquid spraying power supplying device and the liquid column steering device to operate so that the liquid spraying device produces a liquid column.

According to a preferred embodiment of the present disclosure, the housing assembly further comprises from top to bottom an exhibiting shell, a bottom cover, an upper shell, an inner shell, a decorating member, a lower shell and a bottom shell which are connected together in sequence. The exhibiting shell and the bottom cover are joined together to form the exhibiting cavity, the bottom cover and the inner shell are disposed within the upper shell, the bottom cover is fixedly connected to the inner shell to form the partition cavity, the decorating member is nested onto an external sidewall of the lower shell, and the lower shell and the bottom shell are joined together to form the audio cavity.

According to a preferred embodiment of the present disclosure, the exhibiting shell is a housing structure made of a transparent material, a main body of the exhibiting shell is cylinder-shaped, and the top of the exhibiting shell is a hemispheric protrusion.

According to a preferred embodiment of the present disclosure, the bottom cover is detachably connected to the upper shell, and the inner shell is detachably connected to the upper shell.

According to a preferred embodiment of the present disclosure, the liquid spraying device further comprises from top to bottom a sprayer shading plate, a sprayer plate, a sprayer base and a colored lighting plate that are connected together in sequence. Sprayers for liquid spraying are disposed on and protrude from the sprayer plate, the sprayer shading plate is provided with through holes at positions corresponding to the sprayers from which the sprayers protrude respectively, protruding pillars are disposed on and protrude from the sprayer base, the protruding pillars are each provided with a liquid flow channel that is in communication with the liquid spraying power supplying device, the colored lighting plate is provided with through holes at positions corresponding to the protruding pillars through which the protruding pillars pass respectively, colored lights are installed on the colored lighting plate at positions corresponding to the sprayers, and the sprayer base is provided with through holes at positions corresponding to the colored lights through which the light of the colored lights passes.

According to a preferred embodiment of the present disclosure, the sprayer shading plate is made of an opaque material, and the sprayer plate and the sprayer base are made of a transparent material.

According to a preferred embodiment of the present disclosure, the colored lights are LED colored lights.

According to a preferred embodiment of the present disclosure, the water dancing speaker further comprises a limiting plate disposed above the sprayer shading plate and connected to the bottom cover, wherein the limiting plate is adapted to limit the liquid spraying device.

According to a preferred embodiment of the present disclosure, the limiting plate is loop-shaped and is fixedly connected to the bottom cover via a snap-fit structure or a bolt.

According to a preferred embodiment of the present disclosure, the liquid spraying power supplying device comprises a liquid-delivery case, an impeller installed within the liquid-delivery case and a liquid-delivery case cover disposed above the liquid-delivery case to cover the liquid-delivery case, the liquid-delivery case cover is provided with a liquid inlet through which the liquid enters the liquid-delivery case and a liquid outlet that is in communication with the liquid flow channel, a magnet is disposed within the impeller, and the driving device drives the impeller to rotate via a magnetic force so as to drive the liquid within the liquid-delivery case to flow into the sprayer base through the liquid outlet and the liquid flow channel.

According to a preferred embodiment of the present disclosure, the liquid column steering device comprises a link and a driving gear and a driven gear that engage with each other, one end of the link is pivoted to the driven gear while the other end thereof is pivoted to the liquid-delivery case cover, a magnet is disposed within the driving gear, and the driving device drives the driving gear to rotate via a magnetic force so as to drive the liquid spraying power supplying device to rotate.

According to a preferred embodiment of the present disclosure, an eccentric first fixing pillar is disposed on and protrudes from the driven gear, an eccentric second fixing pillar is disposed on and protrudes from the liquid-delivery case cover, the two ends of the link are provided with through holes for fitting with the first fixing pillar and the second fixing pillar respectively, and the two ends of the link are nested onto the first fixing pillar and the second fixing pillar respectively via the through holes.

According to a preferred embodiment of the present disclosure, the driving device comprises a motor, a driving pulley, a driven pulley and a belt, the driving pulley is fixedly installed on an output shaft of the motor, the driven pulley is connected to the driving pulley through the belt, both the driving pulley and the driven pulley are provided with a magnet therein, the impeller is connected to the driving pulley through a magnetic force, and the driving gear is connected to the driven pulley through a magnetic force.

According to a preferred embodiment of the present disclosure, the water dancing speaker further comprises a motor cover nested onto the motor to accommodate the motor, the motor cover is fixed on an external bottom surface of the bottom cover via a bolt, the motor cover is further provided with a stationary shaft to install the driven pulley so as to fix the motor and the driven pulley.

According to a preferred embodiment of the present disclosure, the audio device comprises a loudspeaker, a circuit board and a Bluetooth module, and the circuit board is electrically connected to the loudspeaker, the Bluetooth module, the colored lighting plate and the motor.

According to a preferred embodiment of the present disclosure, the loudspeaker is fixedly installed within the lower shell, the circuit board is a PCB board and is installed on the bottom shell, and the circuit board is integrated with a power interface and an audio interface.

According to a preferred embodiment of the present disclosure, the water dancing speaker further comprises a fixing sheet adapted to fix the loudspeaker, the fixing sheet is U-shaped, each of two ends of the fixing sheet is bent outwardly to form a connecting portion with an installing hole, and the connecting portion is fixedly connected to the lower shell via a bolt so that the loudspeaker is fastened onto the lower shell.

According to a preferred embodiment of the present disclosure, the water dancing speaker further comprises a button assembly. The button assembly comprises buttons and a depressing housing used in cooperation with the buttons, the depressing housing is connected onto the lower shell and shows up from the external sidewall of the lower shell, and the buttons are installed on the circuit board to correspond to the depressing housing.

For the water dancing speaker according to the embodiments of the present disclosure, the liquid spraying device thereof can produce liquid columns that vary rhythmically with the audio characteristics of the played tracks, and meanwhile, the liquid columns are driven by the liquid column steering device to rotate in the horizontal direction so as to generate a wiggly fountain spraying effect. Together with the changing light rays, a dynamic and colorful dancing effect is presented, and this remarkably improves the ornamental value of the speaker.

BRIEF DESCRIPTION OF THE DRAWINGS

To describe the technical solutions of embodiments of the present disclosure more clearly, the attached drawings necessary for description of the embodiments will be introduced briefly hereinbelow. Obviously, these attached drawings only illustrate some of the embodiments of the present disclosure, and those of ordinary skill in the art can further obtain other attached drawings according to these attached drawings without making inventive efforts.

DETAILED DESCRIPTION OF THE INVENTION

Hereinbelow, the technical solutions of embodiments of the present disclosure will be described clearly and completely with reference to the attached drawings. Obviously, the embodiments described herein are only some of but not all of the embodiments of the present disclosure. All other embodiments that can be devised without making inventive efforts by those of ordinary skill in the art upon reviewing the embodiments of the present disclosure shall fall within the scope of the present disclosure.

Figure 1:
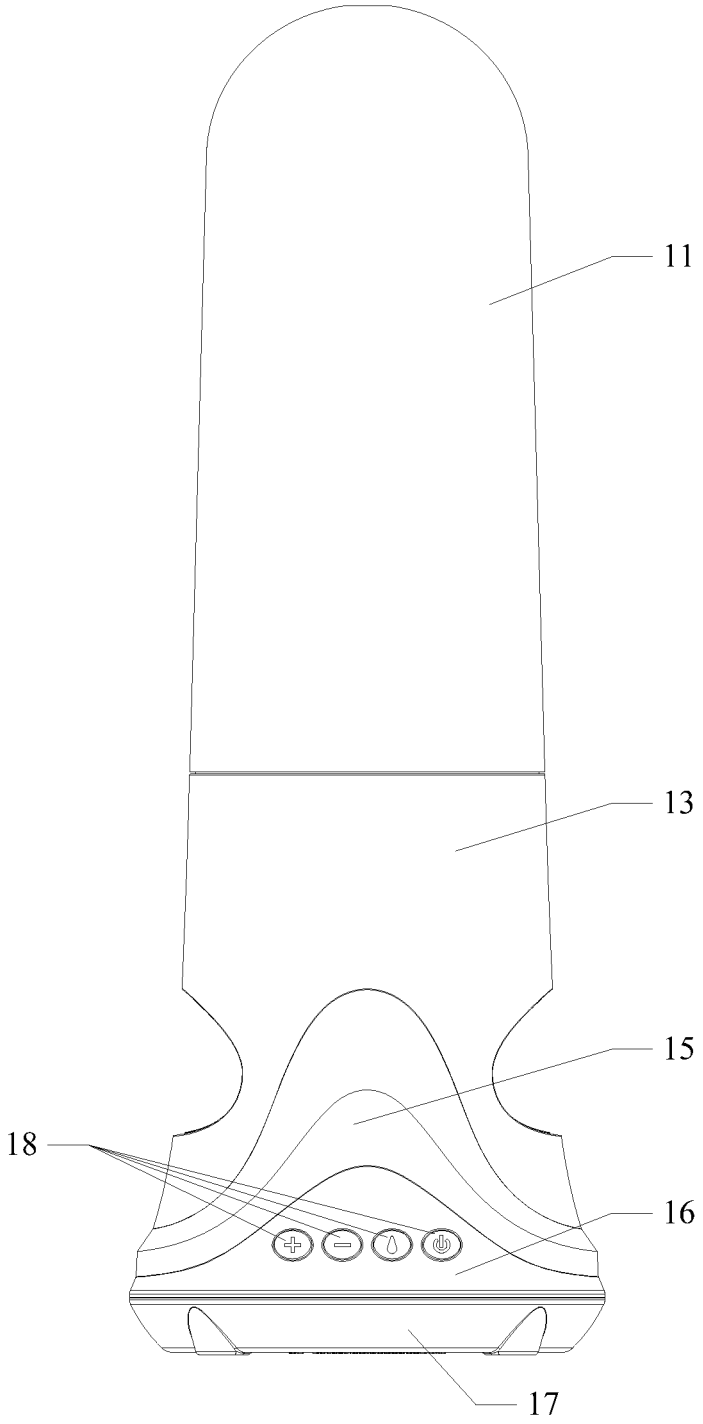
FIG. 1 is a schematic perspective structural view of a water dancing speaker in an assembled state according to a preferred embodiment of the present disclosure.
Figure 2:
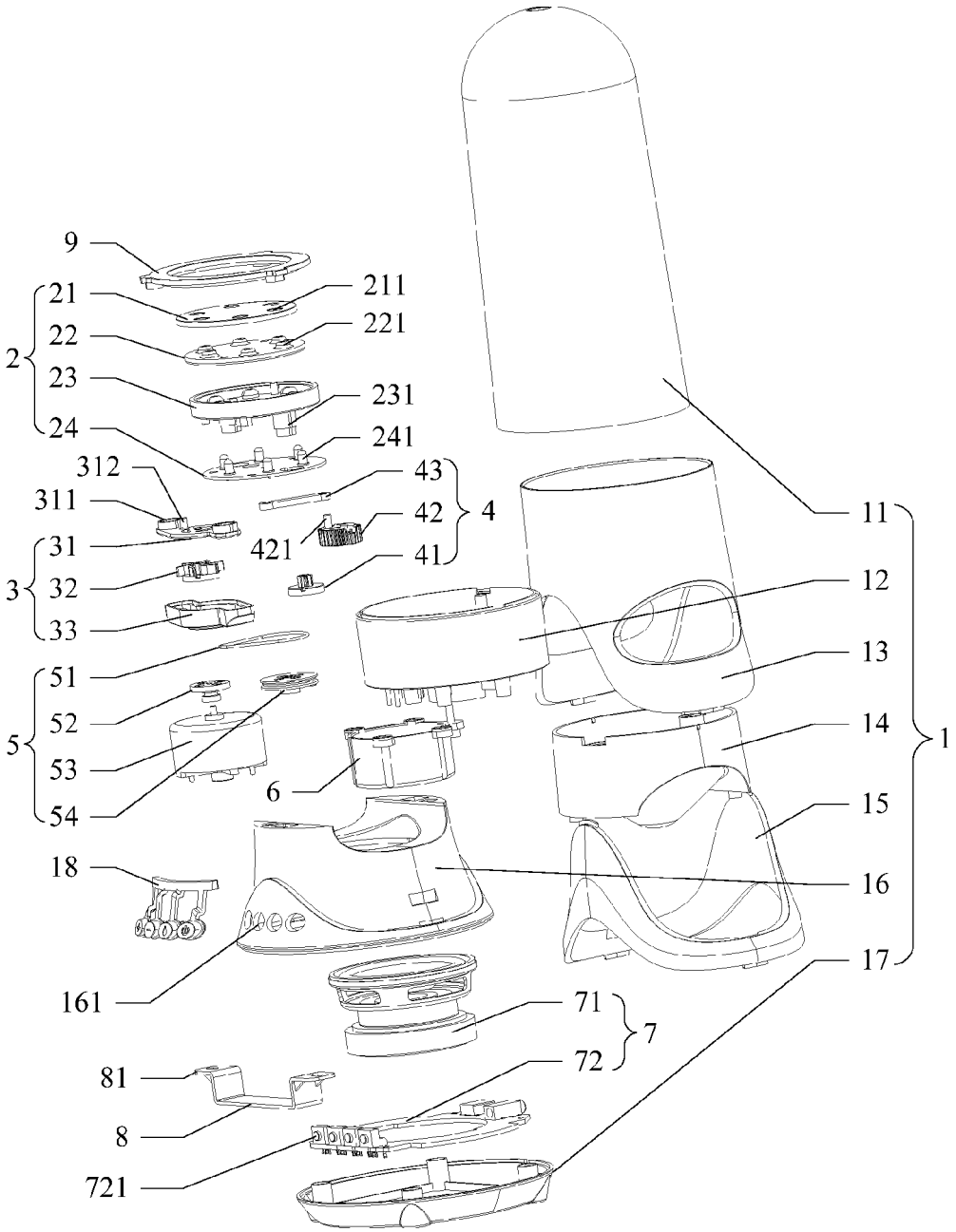
FIG. 2 is a schematic exploded structural view of the water dancing speaker in the embodiment of FIG. 1.

Referring to FIG. 1 and FIG. 2 together, FIG. 1 is a schematic perspective structural view of a water dancing speaker in an assemble state according to a preferred embodiment of the present disclosure; and FIG. 2 is a schematic exploded structural view of the water dancing speaker in the embodiment of FIG. 1. In this embodiment, the water dancing speaker comprises a housing assembly 1, a liquid spraying device 2, a liquid spraying power supplying device 3, a liquid column steering device 4, a driving device 5 and an audio device 7.

Specifically, the housing assembly 1 is formed with an exhibiting cavity (the upper transparent section of the water dancing speaker), a partition cavity (the middle section of the water dancing speaker) and an audio cavity (the bottom section of the water dancing speaker). The liquid spraying device 2, the liquid spraying power supplying device 3 and the liquid column steering device 4 are accommodated within the exhibiting cavity, and the exhibiting cavity is filled with a liquid, which may be oil or water and no limitation is made thereto. The driving device 5 is accommodated within the partition cavity, the audio device 7 is accommodated within the audio cavity, the liquid spraying power supplying device 3 is connected to the liquid spraying device 2 and the liquid column steering device 4 respectively, and the driving device 5 drives, via a magnetic force, the liquid spraying power supplying device 3 and the liquid column steering device 4 to operate so as to drive the liquid spraying device 2 to produce a liquid column.

The liquid spraying device 2 is adapted to produce liquid columns that vary rhythmically with the audio characteristics of the played tracks, and the liquid columns may be pure and transparent liquid columns or colored liquid columns, and no limitation is made thereto. The liquid spraying power supplying device 3 is adapted to provide the accumulated liquid to the liquid spraying device 2. The liquid column steering device 4 is adapted to drive the liquid spraying device 2 to rotate while the liquid spraying device 2 is producing the liquid columns so that the liquid columns in the vertical direction can rotate along the horizontal direction to generate the wiggly fountain spraying effect.

The driving device 5 is connected to the liquid spraying power supplying device 3 and the liquid column steering device 4 respectively via an attraction force formed between magnets so that the driving device 5 is completely isolated from the exhibiting cavity. In this way, it can be ensured that the electrically connected driving device 5 will not fail due to accidentally contact with an electrically conductive medium (e.g., liquid).

The audio device 7 comprises at least two structures, i.e., a sound producing device adapted to play tracks and an electrically controlling device adapted to control the water dancing speaker to generate the fountain spraying effect. It shall be appreciated that, the part of the housing assembly 1 that forms the exhibiting cavity is a transparent housing and forms an enclosed space therein so as to prevent spilling of the produced fountain from the exhibiting cavity. Moreover, the exhibiting cavity is isolated from the partition cavity to prevent the liquid for forming the fountain from permeating into the driving device 5 so as to ensure a normal operation of the driving device 5. When the water dancing speaker of the present disclosure is playing a track, the liquid spraying device 2 thereof can produce liquid columns that vary rhythmically with the audio characteristics of the played track, and meanwhile, the liquid columns are driven by the liquid column steering device 4 to rotate in the horizontal direction so as to generate the wiggly fountain spraying effect. Thus, a special effect of dynamic water dancing is presented, which improves the ornamental value of the speaker remarkably.

Specifically, the housing assembly 1 comprises from top to bottom an exhibiting shell 11, a bottom cover 12, an upper shell 13, an inner shell 14, a decorating member 15, a lower shell 16 and a bottom shell 17 which are connected together in sequence. At least the exhibiting shell 11 is a housing structure made of a transparent material, a main body of the exhibiting shell 11 is cylinder-shaped, and the top of the exhibiting shell 11 is a hemispheric protrusion. The bottom cover 12 and the inner shell 14 are of basically the same shape, i.e., both are cylinder-shaped. The shape of the upper shell 13 fits with the shape of the exhibiting shell 11 (i.e., the upper shell 13 is cylinder-shaped), and a side surface of the upper shell 13 is provided with through holes for playing sound. The exhibiting shell 11 and the bottom cover 12 are joined together to form the exhibiting cavity, and the connection therebetween is hermetically sealed and undetachable. The bottom cover 12 and the inner shell 14 are disposed within the upper shell 13, the bottom cover 12 is detachably connected to the upper shell 13, and the inner shell 14 is detachably connected to the upper shell 13. For example, the detachable connection may be achieved via a bolt.

The bottom cover 12 is fixedly connected to the inner shell 14 to form the partition cavity; and the lower end of the upper shell 13 and the upper end of the decorating member 15 are joined together and are fixedly connected together via a corresponding snap-fit structure. A nesting area fitting with the internal-side shape of the decorating member 15 is concavely disposed on an external sidewall of the lower shell 16, and the decorating member 15 is nested onto the nesting area of the lower shell 16 and fixedly connected to the lower shell 16 via a snap-fit structure. The lower shell 16 and the bottom shell 17 are joined together to form the audio cavity, and preferably the lower shell 16 is fixedly connected to the bottom shell 17 via a bolt or a snap-fit structure. It shall be appreciated that, the appearance and the shape of the housing assembly 1 and the connection manners between the components of the housing assembly described above are only of a preferred embodiment. In other embodiments of the present disclosure, the housing assembly 1 may be of any other suitable shapes, e.g., may be a cylindrical structure with an oval or polygonal cross section, and this will not be further described herein.

The liquid spraying device 2 comprises from top to bottom a sprayer shading plate 21, a sprayer plate 22, a sprayer base 23 and a colored lighting plate 24 that are connected together in sequence. In this preferred embodiment, the components of the liquid spraying device 2 are all circular structures. The sprayer shading plate 21 is made of an opaque material, and both the sprayer plate 22 and the sprayer base 23 are made of a transparent material. Of course, the sprayer plate 22 and the sprayer base 23 may also be made of an opaque material. Sprayers 221 for liquid spraying are disposed on and protrude from the sprayer plate 22, and a central position of each of the sprayers 221 is provided with a liquid spraying hole running through the sprayer plate 22. In this embodiment, the sprayers 221 are preferably arranged on the sprayer plate 22 around the center of the sprayer plate 22. The sprayer shading plate 21 is provided with through holes at positions corresponding to the sprayers 221 from which the sprayers 221 protrude respectively, protruding pillars 231 are disposed on and protrude from the sprayer base 23, and the protruding pillars 231 are each provided with a liquid flow channel that is in communication with the liquid spraying power supplying device 3. The colored lighting plate 24 is provided with through holes at positions corresponding to the protruding pillars 231 through which the protruding pillars 231 pass respectively, and moreover, colored lights 241 are installed on the colored lighting plate 24 at positions corresponding to the sprayers 221.

In this embodiment, the colored lights 241 are preferably LED colored lights, and the sprayer base 23 is provided with through holes at positions corresponding to the colored lights 241 through which the light of the colored lights 241 passes. Thus, the light emitted from the colored lights 241 can pass through the sprayer base 23, the sprayer plate 22 and the sprayer shading plate 21 sequentially and upwardly propagate into the liquid columns sprayed. Then, changing light beams are formed by virtue of the refraction effect of the liquid columns to further present a dynamic and colorful dancing effect, which improves the ornamental value of the speaker remarkably. It shall be appreciated that, the number of the sprayers 221 may be determined depending on practical needs as long as the number of the through holes on the sprayer shading plate 21 corresponds to the number of the sprayers 221, and no limitation is made thereto.

Preferably, the water dancing speaker further comprises a limiting plate 9 disposed above the sprayer shading plate 21 and connected to the bottom cover 12. The limiting plate 9 is loop-shaped and fixedly connected to the bottom cover 12 via a snap-fit structure or a bolt so as to limit the liquid sprayer device 2 for purpose of fixation.

Specifically, the liquid spraying power supplying device 3 comprises a liquid-delivery case 33, an impeller 32 installed within the liquid-delivery case 33 and a liquid-delivery case cover 31 disposed above the liquid-delivery case 33 to cover the liquid-delivery case 33, and the liquid-delivery case cover 31 is provided with a liquid inlet (not shown) through which the liquid enters the liquid-delivery case and a liquid outlet 311 that is in communication with the liquid flow channel of the protruding pillar 231. In this embodiment, preferably, the liquid inlet is disposed at the central position of the liquid-delivery case cover 31 and the liquid outlet 311 is disposed near the outer edge of the liquid-delivery case cover 31. The end of each of the protruding pillars 231 extends into the liquid outlet 311 so that the liquid flow channel of each of the protruding pillars 231 is in communication with the liquid-delivery case 33. A magnet (not shown) is disposed within the impeller 32, and the driving device 5 drives, via a magnetic force, the impeller 32 to rotate so as to drive the liquid within the liquid-delivery case 33 to flow into the sprayer base 23 through the liquid outlet 311 and the liquid flow channel of each of the protruding pillars 231. A certain level of internal pressure is formed within the sprayer base 23 so that the liquid therein is sprayed upwardly through the sprayers 221 to form liquid columns that vary rhythmically, and meanwhile, the liquid columns are driven by the liquid column steering device 4 to rotate in the horizontal direction so as to generate the wiggly fountain spraying effect. Together with the changing light rays, a dynamic and colorful dancing effect is presented, and this remarkably improves the ornamental value of the speaker. The exhibiting cavity is an enclosed structure, so the liquid for forming the fountain will not be sprayed to the outside and the liquid loss is relatively small. Moreover, the liquid within the exhibiting cavity flows back to the liquid-delivery case 33 through the liquid inlet of the liquid-delivery case cover 31 under the action of gravity.

The liquid column steering device 4 comprises a link 43, and a driving gear 41 and a driven gear 42 that engage with each other, and stationary shafts are disposed at corresponding positions on an internal bottom surface of the bottom cover 12 to install the driving gear 41 and the driven gear 42 respectively. One end of the link 43 is pivoted to the driven gear 42 while the other end thereof is pivoted to the liquid-delivery case cover 31 so that a crank-link mechanism is formed. A magnet (not shown) is disposed within the driving gear 41, and the driving device 5 drives, via a magnetic force, the driving gear 41 to rotate so as to drive the liquid spraying power supplying device 3 to rotate. Thus, the liquid columns sprayed through the sprayers 221 are sloped to generate various dancing effects.

In a preferred embodiment, an eccentric first fixing pillar 421 is disposed on and protrudes from the driven gear 42, an eccentric second fixing pillar 312 is disposed on and protrudes from the liquid-delivery case cover 31, the two ends of the link 43 are provided with through holes for fitting with the first fixing pillar 421 and the second fixing pillar 312 respectively, and the two ends of the link 43 are nested onto the first fixing pillar 421 and the second fixing pillar 312 respectively via the through holes thereon.

The driving device 5 comprises a motor 53, a driving pulley 52, a driven pulley 54 and a belt 51, the driving pulley 52 is fixedly installed on an output shaft of the motor 53, the driven pulley 54 is connected to the driving pulley 52 through the belt 51, both the driving pulley 52 and the driven pulley 54 are provided with a magnet (not shown) therein, the impeller 32 is connected to the driving pulley 52 through a magnetic force, and the driving gear 41 is connected to the driven pulley 54 through a magnetic force. Furthermore, the water dancing speaker further comprises a motor cover 6 nested onto the motor 53 to accommodate the motor 53, the motor cover 6 is fixed on an external bottom surface of the bottom cover 12 via a bolt, the motor cover 6 is further provided with a stationary shaft to install the driven pulley 54 so as to fix the motor 53 and the driven pulley 54.

In operation of the water dancing speaker of the present disclosure, the motor 53 rotates at a specific rotational speed (e.g., rotate rapidly, slowly or intermittently) according to the rhythm of the played track, and the motor 53 drives the driving pulley 52 and the driven pulley 54 to rotate. Both the driving pulley 52 and the corresponding impeller 32 are installed with a magnet, so the driving pulley 52 can drive the impeller 32 to rotate via a magnetic force. The high-speed rotation of the impeller 32 can apply a mechanical driving force to the liquid in the liquid-delivery case 33 so that the liquid in the liquid-delivery case 33 flows into the sprayer base 23 through the liquid outlet 311 and the liquid flow channel of the protruding pillar 231 and then is sprayed to the outside through the sprayers 221. When the liquid columns in the vertical direction are formed, the driven pulley 54 can drive, via a magnetic force, the driving gear 41 to rotate because both the driven pulley 54 and the corresponding driving gear 41 are installed with a magnet, and then the liquid spraying power supplying device 3 and the liquid spraying device 2 are driven to rotate so that the liquid columns sprayed through the sprayers 221 are sloped. As can be known from this, the water dancing speaker of the present disclosure can achieve the liquid spraying function and the liquid columns dancing effect simply through a motor 53, so the mechanical structure thereof is simple and useful and the cost is low.

The audio device 7 comprises a loudspeaker 71, a circuit board 72 and a Bluetooth module (not shown), and the circuit board 72 is electrically connected to the loudspeaker 71, the Bluetooth module, the colored lighting plate 24 and the motor 53. The Bluetooth module is adapted to be connected with a corresponding sound device (e.g., a mobile phone) to play the music. The loudspeaker 71 is fixedly installed within the lower shell 16, the circuit board 72 is a PCB board and is installed on the bottom shell 17, and the circuit board 72 has structures such as a power interface and an audio interface integrated thereon. Moreover, the Bluetooth module may also be integrated on the circuit board 72 to simplify the electrically controlling structure of the water dancing speaker.

Preferably, the water dancing speaker further comprises a fixing sheet 8 adapted to fix the loudspeaker 71. In a preferred embodiment, the fixing sheet 8 is U-shaped, each of two ends of the fixing sheet 8 is bent outwardly to form a connecting portion 81 with an installing hole, and the connecting portion 81 is fixedly connected to the lower shell 16 via a bolt so that the loudspeaker 71 is fastened onto the lower shell 16. As can be seen from this, the fixing and installation structure of the loudspeaker 71 is simple and convenient to use, and provides a good fixing effect, which can prevent noises caused by insecure installation.

Furthermore, the water dancing speaker further comprises a button assembly for controlling the volume, the fountain spraying effect, the light, etc. of the water dancing speaker so as to facilitate operations of the users and satisfy various individual requirements. The button assembly comprises buttons 721 and a depressing housing 18 used in cooperation with the buttons 721, the depressing housing 18 is connected onto the lower shell 16 and shows up from the external sidewall of the lower shell 16, and the buttons 721 are installed on the circuit board 72 to correspond to the depressing housing 18.

What described above are only preferred embodiments of the present disclosure, but are not intended to limit the scope of the present disclosure. Any equivalent structure replacements that are made according to the specification and the attached drawings of the present disclosure, or any direct or indirect applications of the present disclosure in other related technical fields shall all be covered within the scope of the present disclosure.

What is claimed is:

1. A water dancing speaker, comprising a housing assembly, a liquid spraying device, a liquid spraying power supplying device, a liquid column steering device, a driving device and an audio device, wherein the housing assembly is formed with an exhibiting cavity, a partition cavity and an audio cavity, the exhibiting cavity and the partition cavity are disposed separately from each other, the liquid spraying device, the liquid spraying power supplying device and the liquid column steering device are accommodated within the exhibiting cavity, the driving device is accommodated within the partition cavity, the audio device is accommodated within the audio cavity, the liquid spraying power supplying device is connected to and drives the liquid spraying device and the liquid column steering device respectively, and the driving device drives, via a magnetic force, the liquid spraying power supplying device and the liquid column steering device to operate so that the liquid spraying device produces a liquid column.

2. The water dancing speaker of claim 1, wherein the housing assembly further comprises from top to bottom an exhibiting shell, a bottom cover, an upper shell, an inner shell, a decorating member, a lower shell and a bottom shell which are connected together in sequence, the exhibiting shell and the bottom cover are joined together to form the exhibiting cavity, the bottom cover and the inner shell are disposed within the upper shell, the bottom cover is fixedly connected to the inner shell to form the partition cavity, the decorating member is nested onto an external sidewall of the lower shell, and the lower shell and the bottom shell are joined together to form the audio cavity.

3. The water dancing speaker of claim 2, wherein the exhibiting shell is a housing structure made of a transparent material, a main body of the exhibiting shell is cylinder-shaped, and the top of the exhibiting shell is a hemispheric protrusion.

4. The water dancing speaker of claim 3, wherein the bottom cover is detachably connected to the upper shell, and the inner shell is detachably connected to the upper shell.

5. The water dancing speaker of claim 2, wherein the liquid spraying device further comprises from top to bottom a sprayer shading plate, a sprayer plate, a sprayer base and a colored lighting plate that are connected together in sequence, sprayers for liquid spraying are disposed on and protrude from the sprayer plate, the sprayer shading plate is provided with through holes at positions corresponding to the sprayers from which the sprayers protrude respectively, protruding pillars are disposed on and protrude from the sprayer base, the protruding pillars are each provided with a liquid flow channel that is in communication with the liquid spraying power supplying device, the colored lighting plate is provided with through holes at positions corresponding to the protruding pillars through which the protruding pillars pass respectively, colored lights are installed on the colored lighting plate at positions corresponding to the sprayers, and the sprayer base is provided with through holes at positions corresponding to the colored lights through which the light of the colored lights passes.

6. The water dancing speaker of claim 5, wherein the sprayer shading plate is made of an opaque material, and the sprayer plate and the sprayer base are made of a transparent material.

7. The water dancing speaker of claim 5, wherein the colored lights are light emitting diode (LED) colored lights.

8. The water dancing speaker of claim 3, further comprising a limiting plate disposed above the sprayer shading plate and connected to the bottom cover, wherein the limiting plate is adapted to limit the liquid spraying device.

9. The water dancing speaker of claim 8, wherein the limiting plate is loop-shaped and is fixedly connected to the bottom cover via a snap-fit structure or a bolt.

10. The water dancing speaker of claim 3, wherein the liquid spraying power supplying device comprises a liquid-delivery case, an impeller installed within the liquid-delivery case and a liquid-delivery case cover disposed above the liquid-delivery case to cover the liquid-delivery case, the liquid-delivery case cover is provided with a liquid inlet through which the liquid enters the liquid-delivery case and a liquid outlet that is in communication with the liquid flow channel, a magnet is disposed within the impeller, and the driving device drives the impeller to rotate via a magnetic force so as to drive the liquid within the liquid-delivery case to flow into the sprayer base through the liquid outlet and the liquid flow channel.

11. The water dancing speaker of claim 5, wherein the liquid column steering device comprises a link and a driving gear and a driven gear that engage with each other, one end of the link is pivoted to the driven gear while the other end thereof is pivoted to the liquid-delivery case cover, a magnet is disposed within the driving gear, and the driving device drives the driving gear to rotate via a magnetic force so as to drive the liquid spraying power supplying device to rotate.

12. The water dancing speaker of claim 11, wherein an eccentric first fixing pillar is disposed on and protrudes from the driven gear, an eccentric second fixing pillar is disposed on and protrudes from the liquid-delivery case cover, the two ends of the link are provided with through holes for fitting with the first fixing pillar and the second fixing pillar respectively, and the two ends of the link are nested onto the first fixing pillar and the second fixing pillar respectively via the through holes.

13. The water dancing speaker of claim 6, wherein the driving device comprises a motor, a driving pulley, a driven pulley and a belt, the driving pulley is fixedly installed on an output shaft of the motor, the driven pulley is connected to the driving pulley through the belt, both the driving pulley and the driven pulley are provided with a magnet therein, the impeller is connected to the driving pulley through a magnetic force, and the driving gear is connected to the driven pulley through a magnetic force.

14. The water dancing speaker of claim 13, further comprising a motor cover nested onto the motor to accommodate the motor, wherein the motor cover is fixed on an external bottom surface of the bottom cover via a bolt, the motor cover is further provided with a stationary shaft to install the driven pulley so as to fix the motor and the driven pulley.

15. The water dancing speaker of claim 7, wherein the audio device comprises a loudspeaker, a circuit board and a Bluetooth module, and the circuit board is electrically connected to the loudspeaker, the Bluetooth module, the colored lighting plate and the motor.

16. The water dancing speaker of claim 15, wherein the loudspeaker is fixedly installed within the lower shell, the circuit board is a Printed Circuit Board (PCB) and is installed on the bottom shell, and the circuit board is integrated with a power interface and an audio interface.

17. The water dancing speaker of claim 8, further comprising a fixing sheet adapted to fix the loudspeaker, wherein the fixing sheet is U-shaped, each of two ends of the fixing sheet is bent outwardly to form a connecting portion with an installing hole, and the connecting portion is fixedly connected to the lower shell via a bolt so that the loudspeaker is fastened onto the lower shell.

18. The water dancing speaker of claim 8, further comprising a button assembly, wherein the button assembly comprises buttons and a depressing housing used in cooperation with the buttons, the depressing housing is connected onto the lower shell and shows up from the external sidewall of the lower shell, and the buttons are installed on the circuit board to correspond to the depressing housing.

* * * * *